United States Patent [19]

Haber

[11] 4,007,347

[45] Feb. 8, 1977

[54] SIMPLIFIED ACTUATING SWITCH FOR ELECTRONIC TIMEPIECES

[76] Inventor: Terry M. Haber, 3050 S. Bristol, No. 8C, Santa Ana, Calif. 92707

[22] Filed: July 28, 1975

[21] Appl. No.: 599,647

[52] U.S. Cl. ..... 200/159 R; 58/85.5; 58/90 B; 200/52 R

[51] Int. Cl.[2] ..... H01H 13/50; G04B 27/00; G04B 37/00

[58] Field of Search ..... 200/52 R, 159 R, 159 A, 200/329, 340, 302; 58/23, 50 R, 85.5, 90 R, 90 B, 63, 73

[56] References Cited

UNITED STATES PATENTS

| | | | |
|---|---|---|---|
| 3,884,033 | 5/1975 | Wood | 58/23 R |
| 3,911,664 | 10/1975 | Haber | 58/50 R X |
| 3,911,666 | 10/1975 | Haber | 58/50 R |
| 3,946,173 | 3/1976 | Haber | 58/50 R X |
| 3,952,176 | 4/1976 | Holder et al. | 58/85.5 X |

*Primary Examiner*—James R. Scott
*Attorney, Agent, or Firm*—Ralph B. Pastoriza

[57] ABSTRACT

An improved command and/or set switch for digital type electronic watches which require operation of the command switch to view the display or operation of the set switch for setting the time, comprises a conducting pin extending through an opening in the side of the watch casing towards the interior module contact. A single O-ring provides a seal for the pin within the opening. A spring conductor in the form of a flat band is disposed internally of the casing and makes continuous electrical contact with the casing, this spring also biasing the pin outwardly or away from the internal module contact. With this arrangement, depression of the pin into the casing causes the inner end of the pin to electrically engage the module contact and complete a circuit from the contact through the pin and spring to the casing. The spring not only serves as the conducting medium but also as a shock absorber for the module of the casing.

6 Claims, 4 Drawing Figures

SIMPLIFIED ACTUATING SWITCH FOR ELECTRONIC TIMEPIECES

BACKGROUND OF THE INVENTION

In my copending patent applications Ser. No. 516,688 filed Oct. 21, 1974 now U.S. Pat. No. 3,911,666, entitled ACTUATING MECHANISMS FOR WRIST INSTRUMENTS; Ser. No. 556,335 filed Mar. 7, 1975 now U.S. Pat. No. 3,946,173, entitled WRIST ACTUATED PRESSURE SWITCH FOR WATCHES; and Ser. No. 538,743 filed Jan. 6, 1975 now U.S. Pat. No. 3,916,664, entitled ACCELERATION/DECELERATION ACTUATING MECHANISM FOR WRIST INSTRUMENTS, there are disclosed electronic watches of the digital read-out type, the display constituting either light emitting-diodes or liquid crystals. These applications deal with inertia and/or pressure actuated switches for rendering the display visible. Such switches as our described and shown may be used in place of or in conjunction with the conventional push-button switch on the side of the watch casing which is required to be depressed in order to render the display visible.

Even though inertia or pressure responsive switches are useful in that they eliminate the necessity for the user to use his other hand to actuate the display, most watches still include the normal manually operable push button and in certain applications or uses, it may be desirable to provide this specific type of manual control; for example, in environments where the wrist watch might be subject to constant shaking or battering about thus raising the possibility of inadvertent operation of inertia type switches. The manually operable push button type switch normally used, however, is a relatively expensive item. Generally, up to five separate parts are required. First, there is a sleeve in which a plunger or pin can move, this sleeve being fixed within an opening in the side of the watch casing. Also normally provided is a coiled spring surrounding the pin and biasing it away from an internal contact within the watch casing. A sealing O-ring is also provided as well as an end contact rivet for the pin. Essentially, the only function of the switch is to electrically connect an internal contact to the watch casing which serves as a ground or return circuit. The reliability as well as the expense of digital type watches could be reduced by merely simplifying the actuating push button type of switch. However, the art is devoid at the present time of any type of control other than that described.

BRIEF DESCRIPTION OF THE PRESENT INVENTION

With the foregoing in mind, the present invention contemplates the provision of a simplified actuating switch for electronic timepieces or digital watches which is not only substantially less expensive to manufacture than conventional switches but is more reliable in operation.

Briefly, the invention contemplates a conducting pin passing through an opening in the side of the watch casing in a direction towards the internal module contact which is to be electrically connected to the casing. A spring conductor is provided in the interior of the casing engaging the pin to bias it away from the contact, the spring conductor always being in continuous electrical engagement with the watch casing. A sealing O-ring is provided about the pin within the opening in the casing, this opening serving as a guide for movement of the pin. By then simply urging the pin inwardly against the bias of the spring, the inner end of the pin will electrically engage the contact and complete an electrical circuit between the contact and the casing through the medium of the conducting pin and the spring conductor.

From the foregoing, it will be seen that there are only three basic parts; to wit, the pin, the O-ring, and the spring conductor. Additionally, the spring conductor is so designed as to function as a shock absorber for the module within the casing.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
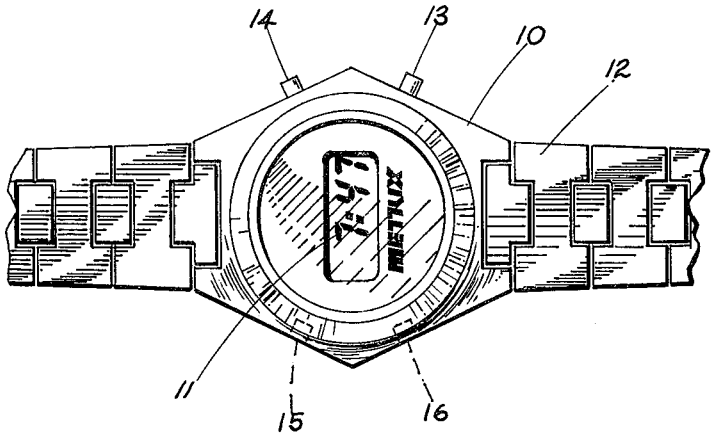
FIG. 1 is a plan view of an electronic timepiece illustrating the locations of various push button type switches for performing various functions wherein the switch construction of the present invention is used.

Referring first to FIG. 1, there is shown a watch casing 10 having a display area 11 and provided with the usual wristed band 12. As is characteristic of all digital type electronic watches, there is required at least one command type push button usually located on the side of the casing to render the display 11 visible when a user wishes to tell the time. Also, there is provided a set button which can be depressed to set the time.

In the more sophisticated types of watches, the display can be changed by a further command button to display the date. In this latter event, an additional set button would be provided to set the date. In the showing of FIG. 1 two command buttons 13 and 14 are provided and two set buttons 15 and 16. The set buttons 15 and 16 are flush with the casing surface; that is, they do not extend beyond the casing exterior in order to avoid inadvertent operation. The command buttons 13 and 14 on the other hand, would normally extend beyond the exterior of the casing for easy manual depression by the user's other hand.

In the example of FIG. 1, the command button 13 would display the time while the command button 14 would display the date. The set button 15 could be used to set the time and the set button 16 to set the date.

Each of the buttons shown in FIG. 1 is designed in accord with the present invention to perform the switch function more efficiently, with less component parts, and with increased reliability. Equally important is the fact that the switches of this invention can be produced for a fraction of the cost of the normally provided command and set switches.

Regardless of whether the switch is a command switch or set switch, in each instance an internal contact on the watch module is electrically bridged to the watch casing. In the watch of FIG. 1, the module within the watch has the appropriate contacts juxtaposed the inner ends of the various push button switches. Accordingly, the operation of each of the switches is identical and a description of one will suffice for all.

Figure 2:
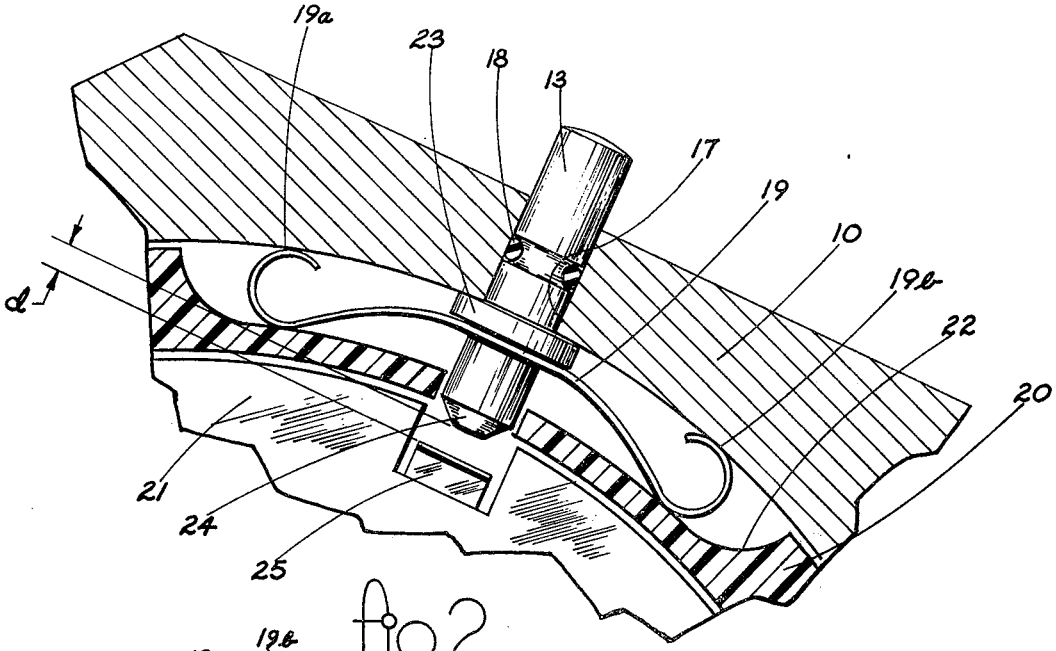
FIG. 2 is a greatly enlarged fragmentary view of one of the switch buttons illustrated in FIG. 1.

Thus, considering specifically the push button 13, and with reference to the enlarged fragmentary view of FIG. 2, it will be noted that the switch button 13 is in the form of an elongated conducting pin, passing thru an opening 17 in the watch casing 10. A single O-ring 18 surrounds the pin 13 within the opening 17 to provide a moisture tight seal and yet permit longitudinal movement of the pin thru the opening, the opening serving as a journaling guide.

A spring conductor 19 in the form of a curved band runs transversely of the inner portion of the pin 13 and includes a center hole thru which the pin passes.

Normally surrounding the watch module between the module and the interior of the casing is a module-positioning spacer 20. The watch module itself is shown at 21. In accord with the present invention, a portion of the module positioning spacer 20 is cut-out as at 22 to accommodate the spring conductor 19 as shown.

The pin 13 itself includes an integral collar 23 against which the periphery of the hole in the spring bares to urge the pin in a direction to space its inner end 24 from a module contact on the module 21. This module contact is shown at 25 and it will be noted that the spacing between the end 24 and contact 25 is designated *d*. The collar 23 serves as a stop for the pain 13 as a result of its engagement with the inner periphery of the opening 17 in the casing 10.

It will be noted that the extending ends of the spring curl towards the inner surface of the casing 10 as indicated at 19*a* and 19*b* on either side of the pin to thereby continuously make electrical contact therewith.

Figure 3:
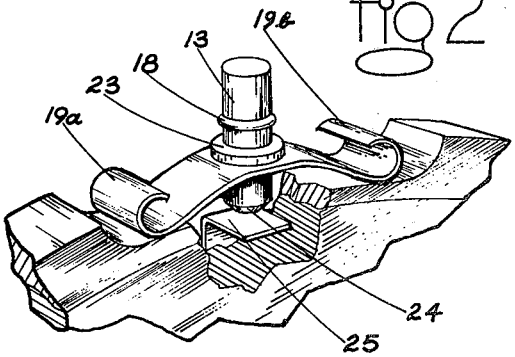
FIG. 3 is a perspective view of the three basic components of the switch in assembled relationship wherein there is additionally illustrated a module contact which is to be electrically connected to the watch casing when the switch is actuated; and, FIG. 4 is a fragmentary view partly in cross section of another one of the push button switches of FIG. 1.

The curved band configuration of the spring will be more evident from FIG. 3, wherein the basic components in the form of the pin 13 with collar 23, O-ring 18, and spring conductor are shown. It will be evident from both FIGS. 2 and 3 that if a manual inwardly directed force is applied to the pin 13, it will flex the spring conductor 19 resulting in a wiping or rolling action of the extending ends 19*a* and 19*b* with the inner surface of the casing 10. Also, the inner ends 24 of the pin 13 will electrically engage the contact 25. A circuit is thus completed from the contact thru the pin and the spring conductor 19 to the casing. The referred to wiping action when the spring is flexed results in a maintaining of good electrical conductivity between the engaging surfaces of the curled portions of the spring conductor and inner surface of the casing 10.

Another consequence of the use of the specific spring conductor described is the fact that it serves as a shock absorber between the module and module spacer and casing.

Figure 4:
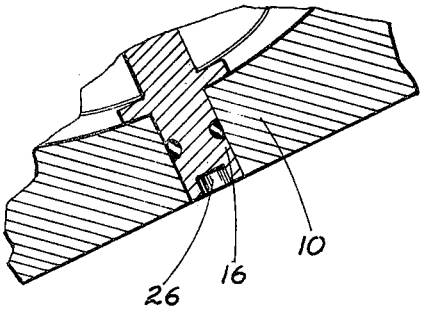

FIG. 4 illustrates a fragmentary portion of the pin 16 of FIG. 1 and the only difference between this pin and the pin 13 described in FIGS. 2 and 3 is the fact that it is shorter so that it does not extend beyond the exterior of the casing 10. Additionally, the exposed end of the pin 16 is provided with a depression 16 convenient for receiving a suitable tool to urge the pin inwardly.

Since the pin 16 and similarly the pin 15 of FIG. 1 are used for date and time setting purposes, they are used relatively infrequently and by recessing the same as described, inadvertent operation thereof is avoided.

From the foregoing description, it will accordingly be evident that the present invention has provided a simplified actuating switch for electronic-type timepieces wherein a minimum number of parts are used and wherein high reliability results. This high reliability is a consequence of the large surface contact area between the extending curled ends of the spring conductor and the casing as well as the configuration of the spring itself. Thus, a less expensive as well as a superior actuating switch results.

What is claimed is:

1. A switch for electrically connecting a module contact interior of the casing of an electronic timepiece to the casing comprising:

a. a pin passing through an opening in the side of said casing in a direction towards said contact; and b. a spring conductor in the form of a band in the interior of said casing engaging said pin and having a transversely extending curved portion engaging the inner surface of said casing in a manner to bias said pin away from said contact, said spring being continuously in electrical engagement with said inner surface, whereby movement of said pin against the bias of said spring through the opening in said casing towards said contact causes the inner end of said pin to engage said contact to thereby electrically connect said contact to said casing through said pin and spring conductor.

2. A switch according to claim 1, including an O-ring surrounding said pin within said opening to provide a seal.

3. In an electronic timepiece having a conductive casing, an internal module with at least one contact, and a module positioning spacing ring, an improved actuating switch for effecting an electrical connection between said contact and said casing, including, in combination:

a. an elongated conductive pin positioned within an opening in the side of said casing for longitudinal movement towards and away from said contact within the casing;

b. an O-ring surrounding said pin within said opening to provide a moisture seal; and c. a spring conductor in the form of a curved band running transversely of the inner portion of said pin and including a center hole through which said pin passes, said module positioning spacing ring having a cut-out portion to accommodate said spring conductor and expose said contact, said pin having a collar against which the periphery of the hole in said spring bears to urge said pin away from said contact, the extending ends of said spring curling towards the inner surface of said casing on either side of said pin to make electrical contact therewith, whereby said spring conductor functions as a shock absorber between said module and casing and as an electrical conductor to complete a circuit from said contact to said casing when said pin is urged from the exterior of the casing towards said contact into electrical engagement therewith against the bias of said spring.

4. The subject matter of claim 3, in which the extending ends of said spring are curled to present a surface contact with said casing such that the conducting surface is wiped when said spring is flexed by movement of said pin, whereby the contacting surfaces are maintained in a conductive condition.

5. The subject matter of claim 3, in which the outer end of said pin extends beyond the exterior of said casing so that it may be manually urged inwardly to close the switch by a user's finger.

6. The subject matter of claim 3, in which the outer end of said pin does not extend beyond the exterior of said casing, said outer end having a depression for receiving a tool for urging the pin towards said contact to close the switch whereby said pin cannot be inadvertently moved into conductive engagement with said contact.

* * * * *